US010113734B2

(12) United States Patent
Richert et al.

(10) Patent No.: US 10,113,734 B2
(45) Date of Patent: Oct. 30, 2018

(54) LIGHT SOURCE FOR A SORTING APPARATUS

(71) Applicants: Gerald Ray Richert, Walla Walla, WA (US); Danielle Wilson, Walla Walla, WA (US); Timothy Justice, Walla Walla, WA (US)

(72) Inventors: Gerald Ray Richert, Walla Walla, WA (US); Danielle Wilson, Walla Walla, WA (US); Timothy Justice, Walla Walla, WA (US)

(73) Assignee: Key Technology, Inc., Walla Walla, WA (US)

( * ) Notice: Subject to any disclaimer, the term of this patent is extended or adjusted under 35 U.S.C. 154(b) by 552 days.

(21) Appl. No.: 14/849,301

(22) Filed: Sep. 9, 2015

(65) Prior Publication Data

US 2015/0377427 A1 Dec. 31, 2015

Related U.S. Application Data

(63) Continuation-in-part of application No. 14/317,551, filed on Jun. 27, 2014, now Pat. No. 9,266,148.

(51) Int. Cl.

| | |
|---|---|
| ***B07C 5/342*** | (2006.01) |
| ***F21V 29/56*** | (2015.01) |
| ***F21K 9/00*** | (2016.01) |
| ***F21V 21/005*** | (2006.01) |
| ***F21S 4/28*** | (2016.01) |
| *F21Y 103/10* | (2016.01) |
| *F21Y 115/10* | (2016.01) |

(52) U.S. Cl.

CPC ..... *F21V 29/56* (2015.01); *B07C 5/342* (2013.01); *F21K 9/00* (2013.01); *F21S 4/28* (2016.01); *F21V 21/005* (2013.01); *F21Y 2103/10* (2016.08); *F21Y 2115/10* (2016.08)

(58) Field of Classification Search

CPC ..... B07C 5/342

See application file for complete search history.

(56) References Cited

U.S. PATENT DOCUMENTS

| | | | |
|---|---|---|---|
| 5,000,569 | A | 4/1991 | Nylund |
| 8,152,347 | B2 | 4/2012 | Brukilacchio |
| 8,283,589 | B2 | 10/2012 | Janssens et al. |
| 2007/0102033 | A1 | 5/2007 | Petrocy |

(Continued)

FOREIGN PATENT DOCUMENTS

| | | | |
|---|---|---|---|
| GB | 2098725 | A | 11/1982 |
| WO | WO2014/055330 | A2 | 4/2014 |

OTHER PUBLICATIONS

PCT International Search Report for PCT Application Serial No. PCT/US16/39985, and dated Sep. 23, 2016.

*Primary Examiner* — Andrew Coughlin

(74) *Attorney, Agent, or Firm* — Randall Danskin P.S.

(57) ABSTRACT

A light source for a sorting apparatus is described and which includes an illuminator having a multiplicity of modules which are electrically coupled together, and which further include a plurality of light emitting diodes which can be selectively energized, by a computer network so as to parametrically control a temporal, spatial, and spectral energizing of the respective modules; and a light diffuser member is located in spaced relation relative to the illuminator, and which passes and substantially renders a visibly luminous or invisible emission substantially uniform.

11 Claims, 6 Drawing Sheets

(56) References Cited

U.S. PATENT DOCUMENTS

| | | | | |
|---|---|---|---|---|
| 2014/0084809 | A1 | 3/2014 | Catalano | |
| 2015/0267891 | A1* | 9/2015 | Burchill | F21V 3/0625 362/235 |
| 2015/0377427 | A1 | 12/2015 | Richert et al. | |

* cited by examiner

LIGHT SOURCE FOR A SORTING APPARATUS

TECHNICAL FIELD

The present invention relates to an illuminator which is used to implement a method and apparatus for sorting, and more specifically to an illuminator which is controlled in a manner so as to allow a sorting apparatus to generate multi-modal, multi-spectral images which contain up to eight or more simultaneous channels of data, and which further contain information on color, polarization, fluorescence, texture, translucence, and other information which comprises many aspects or characteristics of a feature space, and which further can be used to represent images of objects for identification and feature and flaw detection.

BACKGROUND OF THE INVENTION

The problems associated with imaging features on objects to be sorted by utilizing cameras of various types are well known. In this regard, camera images, including line scan cameras, are commonly combined with laser scanners or LIDAR, and/or time of flight imaging, and which is employed for 3-dimensional viewing, and which further is used to perceive depth and distance and to further track moving objects and the like. Such devices have been employed in sorting apparatuses of various designs in order to identify acceptable and unacceptable objects or products within the stream of products to be sorted, thus allowing the sorting apparatus to remove undesirable objects in order to produce a homogeneous resulting product stream which is more useful for end users like food processes and the like. A method and apparatus for achieving enhanced sorting of a stream of product is set forth in co-pending U.S. application Ser. No. 14/317,551 and which was filed on Jun. 27, 2014. The teachings this co-pending application are incorporated by reference herein. The problems experienced in this industry segment, which are outlined in the currently co-pending application have been difficult to overcome by utilizing the prior art that has been available.

While various prior art devices and methodology have been used heretofore, and which have worked with varying degree of success, various industry segments, such as food processors, and the like, have searched for enhanced means for discriminating between products or objects traveling in a stream, so as to produce ever better quality products, or resulting products having different grades of quality for subsequent supply to various market segments. A light source for a sorting apparatus which avoids the detriments associated with the various prior art devices and methodology used, heretofore, is the subject matter of the present application.

SUMMARY OF THE INVENTION

A first aspect of the present invention relates to a light source for a sorting apparatus which includes an illuminator having a multiplicity of modules which are operably coupled together, and which further mount a plurality of light emitting diodes (LEDs) in a predetermined spatial pattern, and wherein the respective modules of the illuminator have control electronics which are operably coupled with, and respond to a command sent by a computer network, and wherein the computer network, acting in combination with the control electronics, parametrically controls a temporal, spatial and spectral energizing and de-energizing of the respective modules, and individual LEDs so as to emit a luminous emission having predetermined characteristics; and a light diffuser member located in spaced relation relative the illuminator and which passes and substantially renders the luminous emission substantially uniform.

Still another aspect of the present invention relates to a light source for a sorting apparatus and which includes a linear LED illuminator which is formed of multiple modules, and which further matingly, and operably cooperate with each other.

These and other aspects of the present invention, will be discussed in greater detail hereinafter.

DETAILED DESCRIPTION OF THE PREFERRED EMBODIMENTS

Figure 1:
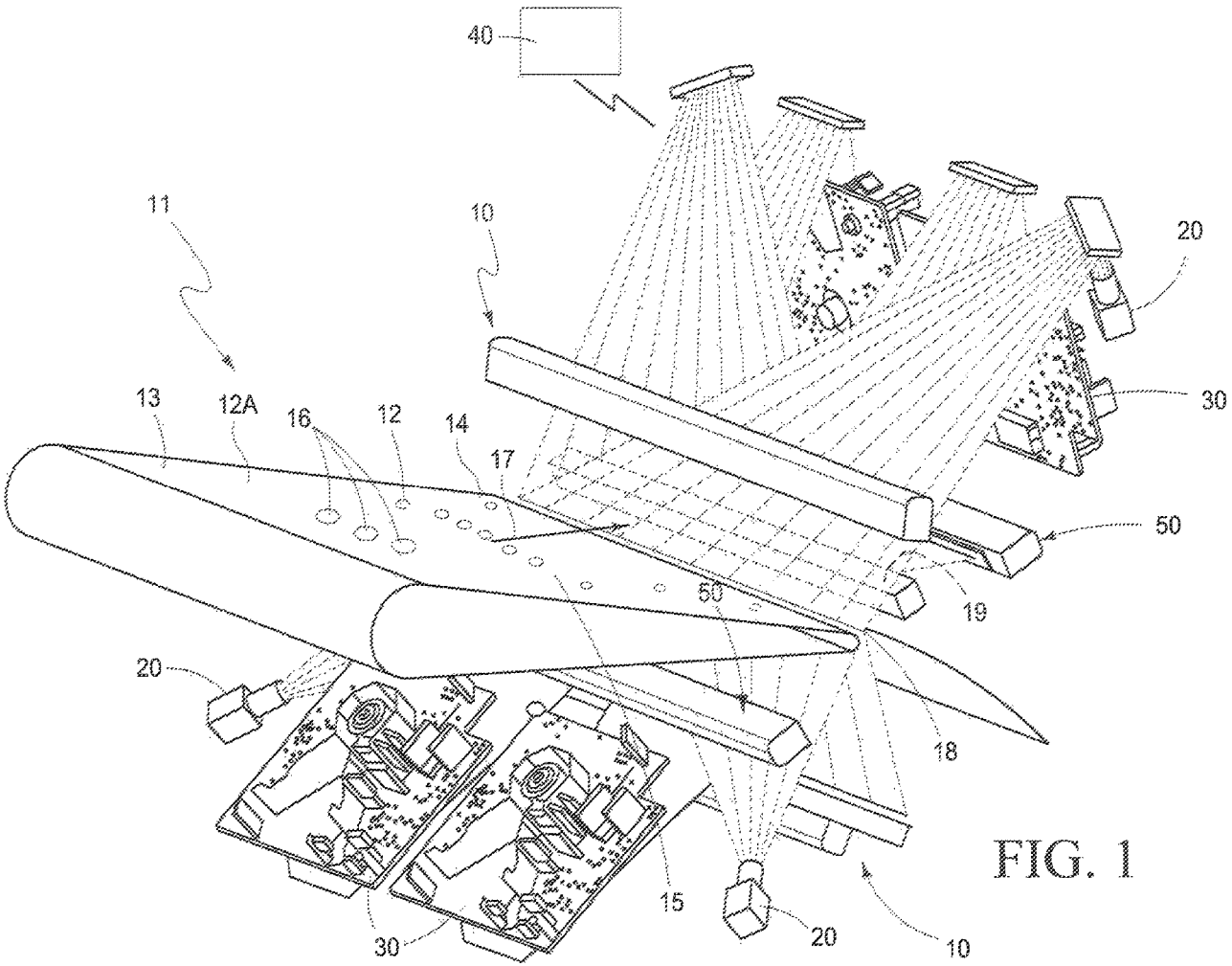
FIG. 1 is greatly simplified, schematic view of a light source for a sorting apparatus of the present invention, and which is located in an operable orientation relative to an apparatus for sorting a product stream.

A light source for a sorting apparatus of the present invention is generally indicated by the numeral 10 in FIG. 1, and following. As seen in FIG. 1, the light source of the present invention is utilized in combination with a sorting apparatus 11, and which is generally schematically depicted therein. The sorting apparatus 11 includes a continuous conveyor 12. The continuous conveyor has an upper, product supporting flight 12A. The continuous conveyor further has an intake end 13, and an opposite exhaust end 14. The continuous conveyor 12 supports a stream of products 15, on the top flight 12A, for travel between the intake end 13, and the exhaust end 14. The stream of products 15 comprise individual objects to be sorted 16. The individual objects to be sorted 16 may include acceptable, as well as unacceptable objects or products 16. The light source 10, when selectively energized, is operable to provide emitted, electromagnetic radiation as will be discussed hereinafter, and which is useful in allowing the sorting apparatus 11 to distinguish features of the individual objects 16, such that downstream sorting decisions can be made, and unacceptable objects 16 may be removed from the stream of products 15. The methodology as to how this sorting task or operation is accomplished is set forth in co-pending U.S. application Ser. No. 14/317,551, and which was filed on Jun. 27, 2014. The substance of that co-pending US patent application is incorporated by reference herein, and further discussion regarding the methodology to achieve the benefits as set forth in that invention are not discussed, at length, in the present patent application.

The sorting apparatus 11, and which utilizes the present invention includes several image-capturing devices 20, and which are positioned both, above, and below, the stream of products 15, and which are released into a freefall path of travel, once the respective products or objects 15 to be sorted depart from the exhaust end 14, of the continuous conveyor 12. In addition to the light source of the present invention 10, the present sorting apparatus 11 includes laser scanners 30, and which are operable to generate a moving beam of electromagnetic radiation which travels back and forth across the path of travel of the stream of product 15, as the objects or products move in a freefall after departing from the exhaust end 14 of the continuous conveyor. The light source 10 of the present invention, as well as the image-capturing devices 20, and laser scanners 30, as illustrated in FIG. 1, are controllably coupled to a computer network or controller and which is only generally indicated by the numeral 40 in FIG. 1. This computer network or controller 40 may be coupled to the optical sorting apparatus 11 by means of an Ethernet connection or wireless technology, depending upon the needs of the end user. In the arrangement as will be discussed in the Specification, hereinafter, the present light source 10 is selectively controlled and energized by an Ethernet controller, which can be mounted in a location which is external to the light source 10. Each Ethernet controller, as will be discussed hereinafter, can control up to two individual light sources 10, as will be discussed in the paragraphs which follow. However, it should be understood that the Ethernet connection through which the light source 10 is operated can be used to selectively energize the light sources 10 so as to cause the selective output of electromagnetic radiation in the form of visible, or invisible light, or electromagnetic radiation in a substantially continuous output, or electromagnetic radiation which is emitted in synchronized pulses, and which have independent start and stop times that are determined on a per channel basis. In this regard each channel can be selectively turned on or off. Further the resulting intensity of electromagnetic radiation which is emitted, whether it be visible, or invisible can be varied, both per channel, and per modular light circuit board segment, as will be described, hereinafter. In the arrangement of the invention, as will be discussed, hereinafter, this invention 10, by means of the Ethernet controllers, provides a means for providing temporal, spatial, spectral and other parametric controls by way of the computer network and controller 40, so as to quantitatively vary the operation of a single light module or multiple light sources by themselves. In this regard, the operational parameters can be controlled concurrently, and synchronously, by way of a timing arrangement which includes emission time, and duration of the emission of the electromagnetic radiation; a selected output of electromagnetic radiation, that is, the light source is either on all the time, or energized only part of the time; start and stop times can be determined independently, per channel; further a simultaneously pulsed and luminous output is available on all channels; and coordinated and sequential color output/emission can be provided either in a synchronized fashion, or by selected channels. The many functions of this light source 10 will be discussed in greater detail in the paragraphs which follow.

Figure 2:
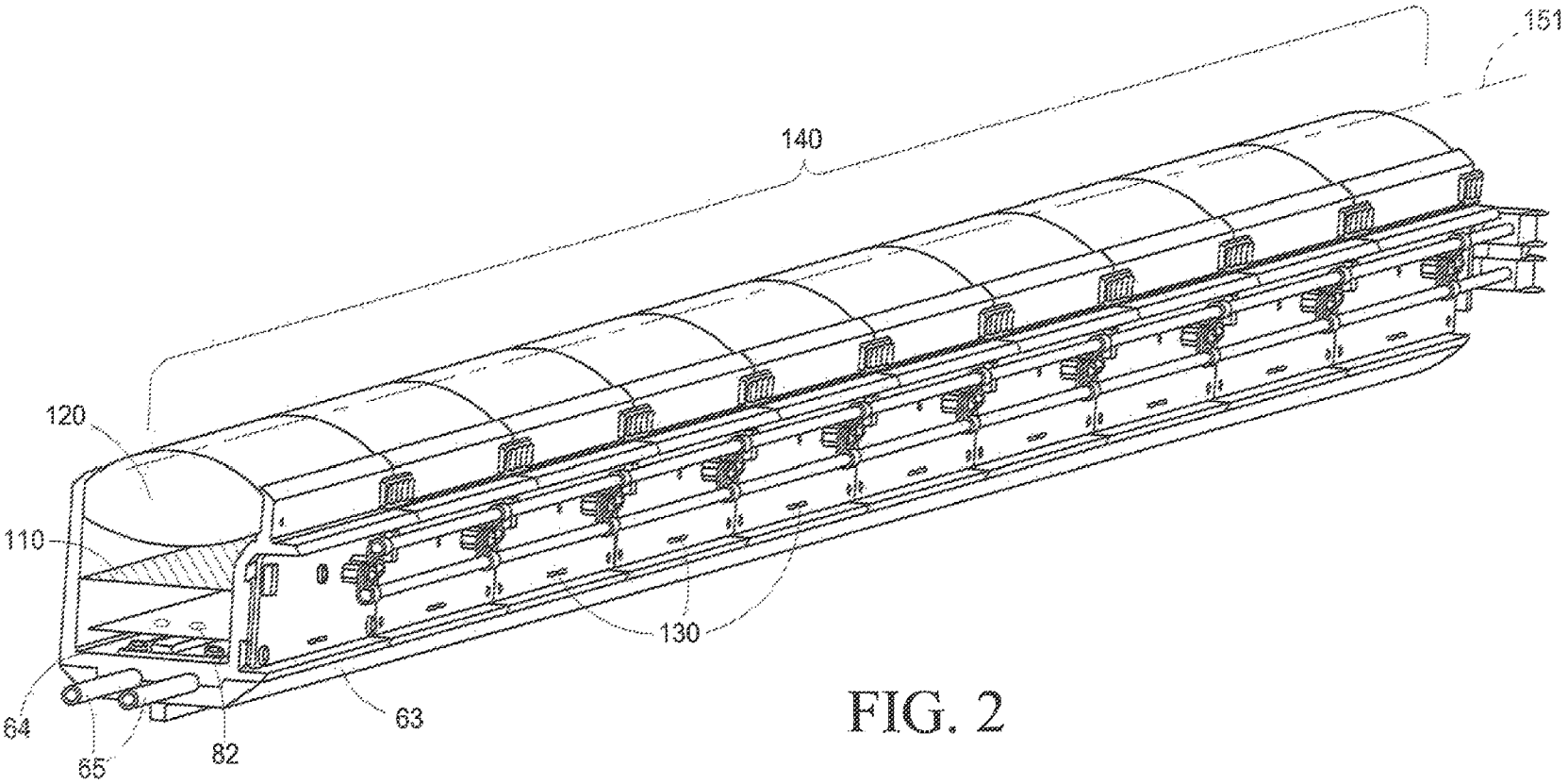
FIG. 2 is a fragmentary, perspective view, of one form of the light source of the present invention.

Referring now to FIG. 2, and following, the light source 10 of the present invention includes a translucent enclosure 50, here illustrated as a cylindrical tube, and wherein the translucent housing has an internal cavity 51, and which has a cross sectional dimension of at least 3.75 inches. As seen in the drawings, the translucent housing or enclosure 50 is at least partially translucent, and further passes a discrete luminous beam as will be described, hereinafter, and which is sent or projected in the direction of the stream of products 15 which are being sorted. The internal cavity 51 of the translucent enclosure 50 is dimensioned to receive component portions of the light source 10 as described, below.

Figure 3:
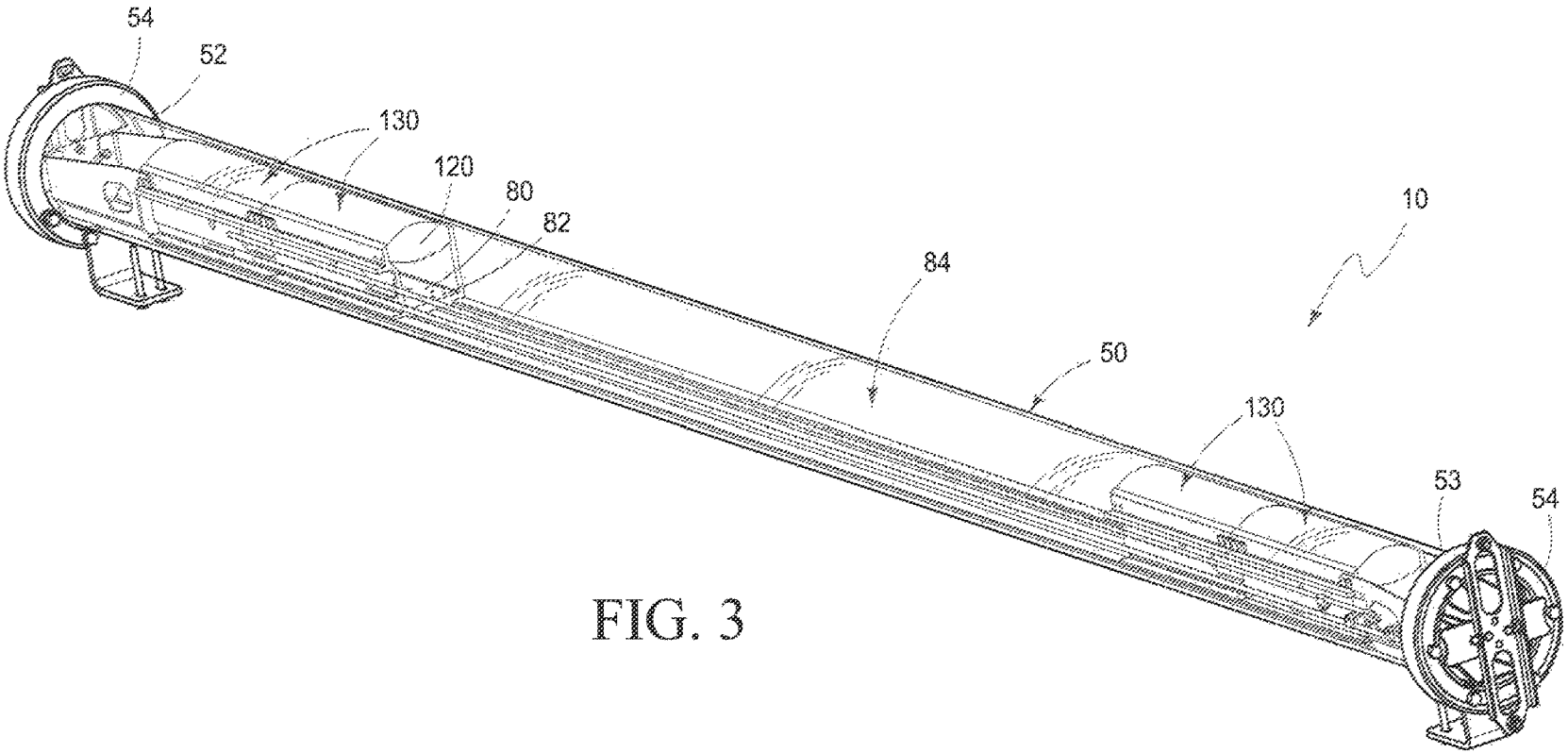
FIG. 3 is a fragmentary, perspective, side-elevation view of a partially assembled light source for use in a sorting apparatus of the present invention.

The translucent enclosure 50 ensures that exterior or ambient environmental conditions such as water; debris from the stream of products 15; dust; and the like, does not unduly affect the component portions of the light source 10, as will be described, below. The translucent enclosure 50 also has opposite ends 52 and 53, respectively. The opposite ends allow access to the internal cavity 51. As best seen in FIG. 3, supporting end caps 54 are provided and are further mounted in partially occluding relation relative to the opposite ends 52 and 53 of the enclosure. The end caps are used, at least in part, to support the translucent enclosure 50 in an appropriate orientation on the sorting apparatus 11.

Figure 4:
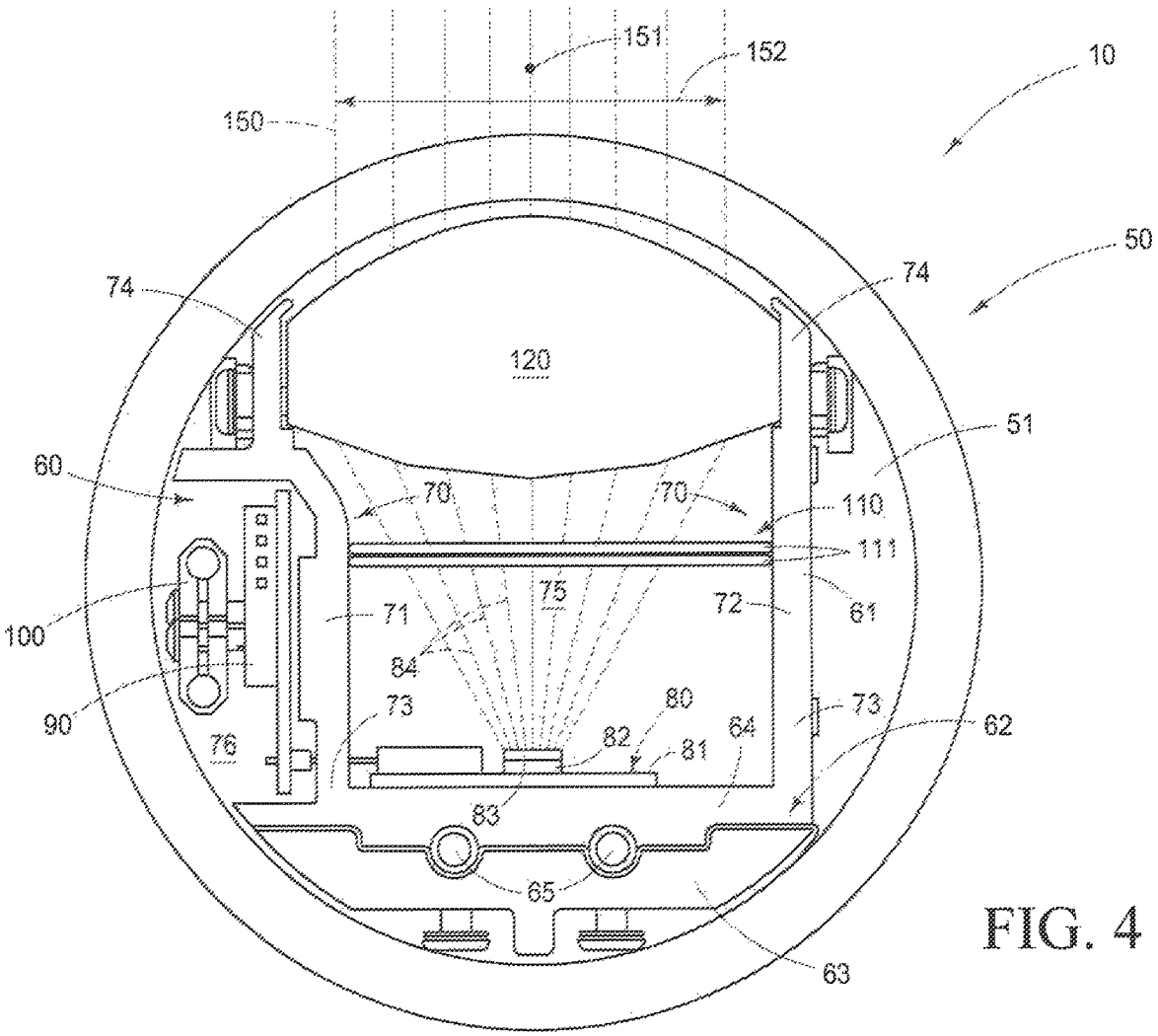
FIG. 4 is a greatly enlarged, transverse, vertical sectional view of one form of the light source of the present invention.

The first form of the light source 10 is generally indicated by numeral 60. Referring now to FIG. 4, the first form of the invention 60 is used to generate a discrete light beam, as described, below, and which is typically employed to illuminate the stream of products or objects 15 while they are moving in the free-fall path of travel. The light source 10 includes an extruded aluminum frame which is generally indicated by the numeral 61, and which further is sized so as to be received with the internal cavity 51 of the translucent enclosure 50. In the transverse vertical sectional view as seen in FIG. 4, the extruded aluminum frame 61 has a base or other supporting member 62, and which further rests within, or is supported by the translucent enclosure 50. The base member 62 is further defined by a first portion 63, and a second portion 64, and which is spaced radially, inwardly therefrom. As best seen by reference to FIG. 4, a cooling assembly in the form of liquid cooling tubes 65, are sandwiched between, and captured by, the first and second portions 63 and 64, respectively. The liquid cooling tubes 65 enclose and circulate a coolant, not shown, and which is operable to remove or dissipate heat energy which is generated by the light source 10, and when it is being energized. It should be understood that the base member 62, and other portions of the extruded aluminum frame 51, operate as a heat sink so as to remove or otherwise dissipate heat energy generated by the electrical components as described, hereinafter, so as to maintain the invention in an operational state.

As seen in FIG. 4, and in the first form of the invention 60, the extruded aluminum frame 61 includes a pair of support members 70 which extend, generally speaking, vertically, upwardly relative to the second portion 64. The pair of support members include a first member 71, and a second member 72. The respective first and second members 71 and 72 each have a first end 73, and which is made integral with the second portion 64; and a distal second end 74. As best seen in FIG. 4, a first cavity 75 is defined between the first and second members 71 and 72. Still further, a second cavity 76, is formed between the first member 71, and the adjacent wall which forms, at least a portion of the translucent enclosure 50.

As best seen in FIG. 4, and in the first form of the invention 60, the light source 10 has a light-emitting diode (LED) electrical board 80. The LED electrical board 80 has a top supporting surface 81. A multiplicity of LEDs 82 are located in a predetermined spatial pattern on the top surface 81. The multiplicity of light-emitting diodes 82 are of traditional design. The light-emitting diodes may be arranged in any number of different spatial patterns and may emit different types of electromagnetic radiation, in predetermined bands, and which may be visible or invisible. As seen in FIG. 4, an optical collection lens 83 is made integral with, and positioned over, and/or operably cooperates with at least some of the underlying light-emitting diode 82. The LED electrical board 80, further electrically couples the individual light-emitting diodes 82 with a source of electrical power, and with the computer network or controller, 40, in a fashion whereby the respective LEDs 82 can be individually, and severally controlled, and energized, in a given order, so as to provide the benefits of the present invention. It should be understood that when the individual LEDs 82 are selectively energized they produce heat energy. This generated heat energy is received or otherwise absorbed by the second portion 64, of the base member 62, and this same heat energy is then absorbed, and then dissipated by the coolant which is circulating within the liquid cooling tubes 65. As should be understood, the liquid cooling tubes operate as a cooling assembly which maintain the LED electrical board 80 at a predetermined operational temperature. As best seen by reference to FIG. 4 the first form of invention 60 includes a driver board 90 of traditional design, and which is electrically coupled with, and disposed in controlling relation relative to, the LED electrical board 80. The driver board 90 is positioned within the second cavity 76, and which is defined between the first member 71, and the translucent enclosure 50. A source of electrical power is distributed to the LED electrical board 80 by a power distribution assembly 100, of traditional design. The power distribution assembly 100 is electrically coupled to the driver board 90, and the LED electrical board 80, in a traditional fashion.

As best seen by reference to FIG. 4, a light diffuser member 110 is positioned within the first cavity 75, and which is defined between the first and second members 71, and 72 of the extruded aluminum frame 61. The light diffuser member may be formed of multiple layers 111. The light diffuser member 110 is formed of a synthetic, translucent, substrate and which further has a random surface topography which changes the direction of the electromagnetic radiation 84 which is emitted by the respective LEDs 82, and which passes therethrough, so as to produce a resulting, and substantially uniformly discrete beam of light or radiation, as will be discussed, hereinafter. Mounted on the second end 74 of each of the first and second members 71 and 72 is an optical focusing lens 120. The optical focusing lens is designed or formed so as to provide or define certain optical characteristics of the resulting discrete luminous beam which will be described, below. The light diffuser member 110, in combination with the optical focusing lens 120, provides a unique optical output, and which allows for improved imaging of individual objects 16, as they move along the free-fall path of travel after the objects or products exit the exhaust end 14 of the continuous conveyor 12.

A suitable light diffuser member 110 can be commercially purchased from a company identified as, Luminit, and which supplies a variety of different light-shaping diffusers which are used to remove LED "hot spots" and the like, and thereby provide substantially uniform illumination for different industrial applications.

Figure 6:
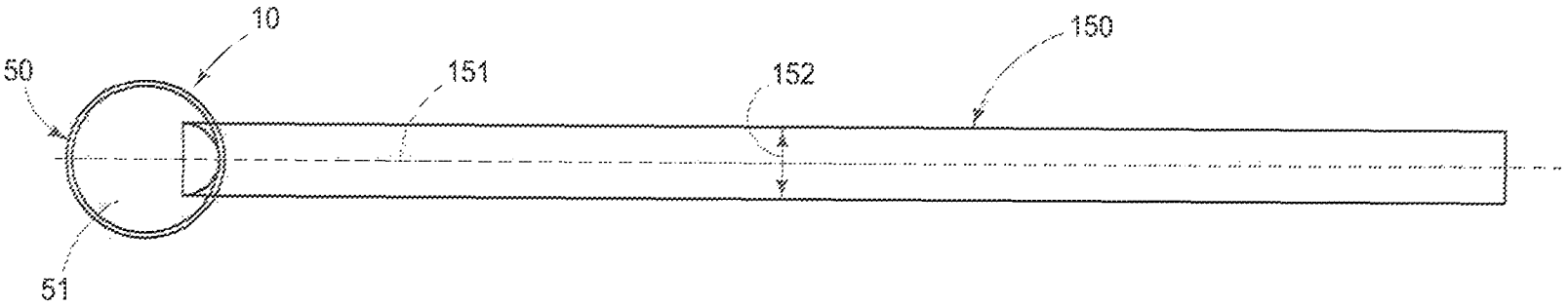
FIG. 6 is a greatly simplified, graphical depiction of the light source of the present invention, and which illustrates the light beam which is emitted by the new invention.

The light source 10, and more specifically the first form 60, thereof, is formed of individual modules 30, and which are best seen by reference to FIGS. 2 and 3, respectively. The individual modules, when mechanically and electrically coupled together, form a linear LED illuminator 140 (FIG. 2) that extends substantially along the entire length of the translucent enclosure 50, and between the end caps 54 thereof. The individual modules 130 provide a convenient means whereby malfunctioning light emitting diodes 82, driver boards 90 or other electrical assemblies can be quickly repaired and/or replaced in order to return a light source 10, back into operation, once a malfunction occurs. The linear LED illuminator 140 has a predetermined length dimension, and when energized, produces a discrete, luminous beam 150, (FIGS. 4 and 6), and which have both a major projection axis 151, and a minor projection axis 152 respectively. The major projection axis of the luminous beam 150 has a length dimension of about 1.0-1.5 times the length dimension of the linear LED illuminator.

In the arrangement as seen in the first form of invention 60, and as best seen in FIG. 4, the respective LEDs 82, which form the linear LED illuminator 140, comprise LEDs 82 which, when energized, emit multiple wavelengths of electromagnetic radiation 84, and which may be visible or invisible. The linear LED illuminator 140 can be selectively controlled by the computer network or controller 40 so as to selectively energize and de-energize the respective LEDs 82 that form the linear LED illuminator 140, in a predetermined manner, so as to provide control over an emission time, and a duration of the energizing of the respective LEDs 82; or a selected luminous emission of the respective LEDs 82; and/or a simultaneous pulsed illumination of predetermined LEDs 82; and/or a coordinated sequential energizing of selected LEDs 82 so as to provide a sequential and/or continuous, predetermined and discrete luminous beam 150 for the linear LED illuminator 140. As noted above, the linear LED illuminator 140, when energized, generates a predetermined uniform illumination which has a working distance of less than about 1.5 meters. Still further the discrete luminous beam 150 has a minor projection axis 152. In this regard, the energized linear LED illuminator 140 has a beam width which, when measured along the minor projection axis is typically less than about 100 millimeters in width. In the arrangement as seen in the drawings, the discrete luminous beam 150 has a peak luminous intensity when measured along the major projection axis 151. Still further the discrete luminous beam 150 has a non-uniform light output, which is provided by the energized linear LED illuminator, and which is less than about 20% of the peak luminous intensity of the discrete luminous beam 150, and when this particular luminous intensity is measured along the major projection axis 151. Still further, and with regard to the minor projection axis 152, the non-uniform light output of the energized linear LED illuminator 140 is less than about 30% of the peak luminous intensity of the discrete luminous beam 140 when this non-uniform light output is measured along the minor projection axis 140. As noted above, the discrete luminous beam 140 has a beam width, and a light output, and when this light output is measured in a region outside the width of the luminous beam, it is less than about 10% of the peak luminous intensity of the discrete luminous beam 140.

Figure 5:
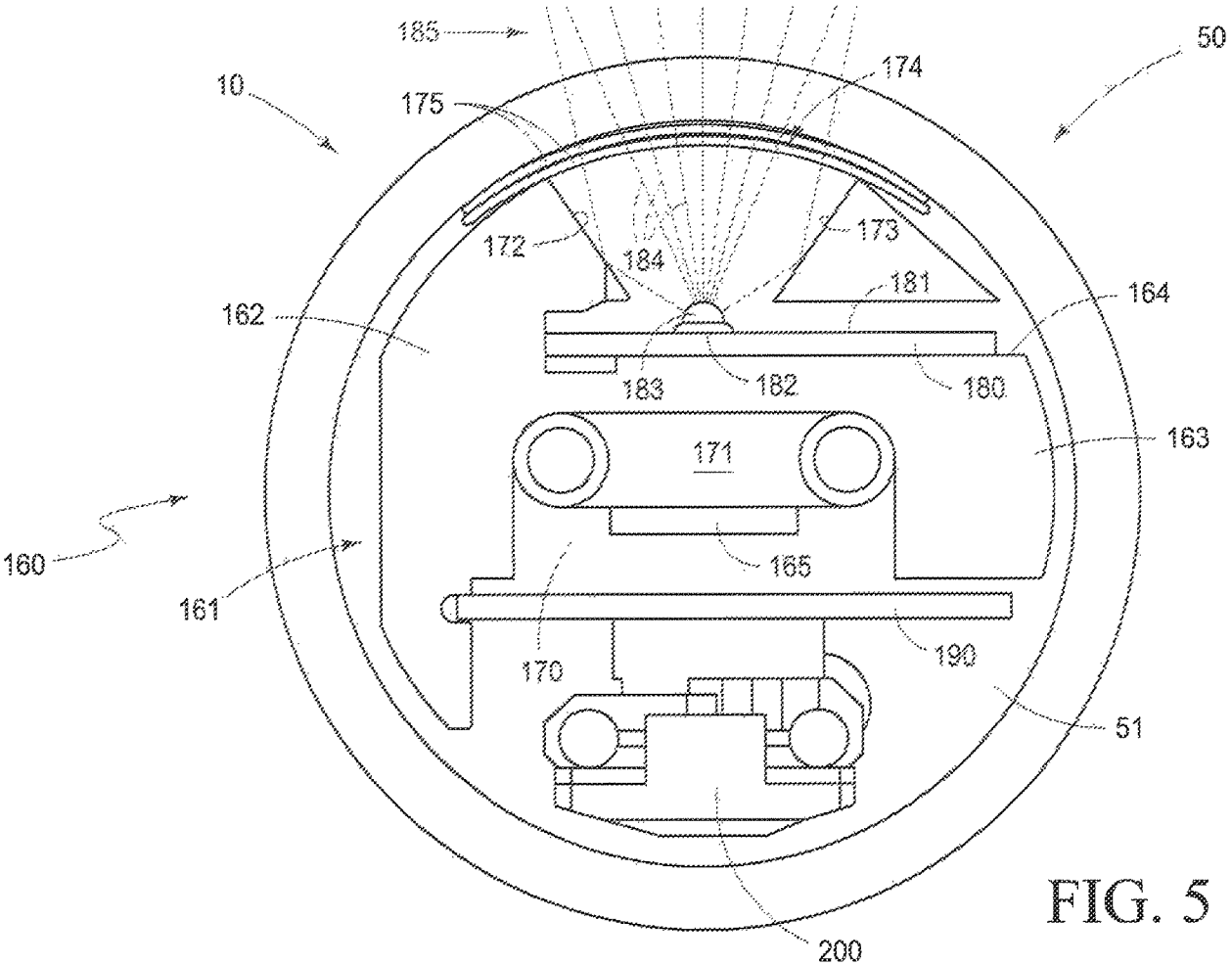
FIG. 5 is a greatly enlarged, transverse, vertical sectional view of a second form of light source for a sorting apparatus of the present invention.

A second form of the invention 160, and which operates as an improved backlight is best seen by reference to FIG. 5. As should be understood a backlight is an assembly which generates electromagnetic radiation, and which is emitted in a direction toward the individual image capture devices 20, as earlier described. In this regard, the second form of the invention 160 is again similar in some respects to the first form of the invention 60 inasmuch as the overall size of the second form the invention 160 is dimensioned so as to be received within the internal cavity 51 of the translucent enclosure 50. As seen in FIG. 5, the second form of the invention 160 includes an extruded aluminum frame 161, and which operates as a heat sink, and which further is useful for removing heat energy which is generated by the electrical components, and which are further received within the internal cavity 51. In this regard the extruded aluminum frame 161 has a first portion 162, and further has a second portion 163, and which is positioned substantially perpendicular to the first portion 162 and is made integral therewith. As seen in FIG. 5 the second portion 163 has a first or top surface 164, and an opposite, or bottom surface 165. As seen in FIG. 5, the second or bottom surface 165 of the second portion 163 defines at least part a cavity 170. The cavity 170 matingly cooperates with a cooling assembly, which is herein illustrated as a liquid conduit 171, and which circulates a coolant, not shown. The liquid conduit 171, and the coolant circulating therein is operable to remove heat energy which is generated by the electrical components of the second form of the invention 160, when energized, so that the second form of the invention may continue in operation for prolonged periods of time. Further, and as seen in FIG. 5, it will be understood that the first portion 162 defines, at least in part, a reflective surface 172, and which is operable to reflect, at least in part, a portion of the emitted electromagnetic radiation 184, in a given pattern, so that the emitted electromagnetic radiation may be transmitted or otherwise passed by the translucent enclosure 50. Spaced from the reflective surface 172 is a separate reflector 173. Again the reflector 173 is operable to reflect or direct, at least in part, the emitted electromagnetic radiation 184 in a predetermined pattern which is generally radially, and outwardly oriented, and towards the translucent enclosure 50. FIG. 5 also shows, in the second form of the invention 160, a light diffuser member 174. The light diffuser member, as illustrated, may be formed of multiple layers of translucent material 175. The light diffuser member 174 is operable to change, at least in part, the direction of the emitted electromagnetic radiation 184 so as to provide a substantially uniform beam of electromagnetic radiation 185, and which is further useful in implementing an effective methodology for sorting a stream of objects or products in a manner which was not possible heretofore. As should be understood, the light diffuser member 174 is sandwiched, or otherwise positioned between the first portion 162 of the extruder aluminum frame 161, and the reflective surface 172, and reflector 173, respectively. Again referring to FIG. 5, the second form 160, of the light source 10, includes an LED [light emitting diode] electrical board 180, and which is similar to the first form 60 of the invention. The LED electrical board 180 is matingly coupled to, and is positioned in heat transmitting relation relative to, the top or first surface 164 of the second portion 163. The LED electrical board 180 has a top surface 181 which mounts a multiplicity of light emitting diodes (LEDs) 183, and which further may produce visible or invisible electromagnetic radiation when selectively energized. Individual optical collection lenses 183 may be individually and matingly associated with at least some of the multiplicity of LEDs 182. When selectively energized the individual LEDs 182 produce emitted electromagnetic radiation 184 which is directed substantially radially, outwardly, and in the direction of the translucent enclosure 50. The translucent enclosure 50 then passes the emitted electromagnetic radiation 184, and which has been passed by the light diffuser member 174. This physical arrangement produces a substantially uniform luminous beam 185. Similar, in some respects to the construction as earlier described with respect to the first form of the invention 60, the second form of the invention 160 has a driver board 190, and which is electrically and controllably coupled to the LED electrical board 180. Further, the second form of the invention 160 similarly has a power distribution assembly 200, and which is electrically coupled to the driver board 190, and which further provides electrical power for energizing the respective light emitting diodes 182, and which are mounted on the LED electrical board 180. These electrical assemblies are selectively energized by way of the computer network or controller 40, as earlier discussed.

Operation

The operation of the described embodiments of the present invention are believed to be readily apparent, and are briefly summarized at this point.

In its broadest aspect the present invention relates and a light source 10 for a sorting apparatus 11. As seen in FIG. 1, and following, and in one form of the invention, the light source 10 includes an illuminator 140 having a multiplicity of modules 130, and which are operably coupled together, and which further mount a plurality of light emitting diodes [LEDs] 82, 182 in a predetermined spatial pattern; and wherein the respective modules 130 of the illuminator 140, have control electronics 90, 190, and which further are operably coupled with, and respond to, a command sent by a computer network, or controller 40. The computer network or controller 40, acting in combination with the control electronic 90, 190, parametrically controls a temporal, spatial and spectral energizing, and de-energizing of the respective modules 130, and individual LEDs 82 and 182, respectively, so as to emit or generate a predetermined visibly luminous, or invisible emission 150, 185, and which has predetermined characteristics; and a light diffuser member 110 and 174, respectively, is provided, and which are individually located in spaced relation relative to the illuminator 140, and which passes and substantially renders the emission 150, 185 substantially uniform.

The sorting apparatus 11, upon which the present illuminators 140 are mounted, includes a source of individual objects or products 16 to be sorted. The sorting apparatus 11 further includes a conveyor 12 for moving the individual products 16 along a given path of travel 17, and into an inspection station 18. The sorting apparatus 11 also includes a plurality of selectively energizable illuminators 140, and which are located in different, spaced, and predetermined angular orientations relative to the inspection station 18, and which, when energized, individually emit electromagnetic radiation 84 and 184, respectively, and which is generally directed towards, and is reflected at least in part from, and/or transmitted by, the respective products 16 which are passing through the inspection station 18. The sorting apparatus 11 as previously described includes a plurality of selectively operable image capturing devices 20, and which are located in different, spaced, angular orientations relative to the inspection station 18, and which further, when rendered operable, captures the electromagnetic radiation 84 and 184, respectively, and which is reflected from and/or transmitted by, the individual products 16 which are passing through the inspection station 18, and forms an image of the electromagnetic radiation which is captured. In the arrangement as seen in the drawings, the respective image capturing devices 20 each form an image signal. The sorting apparatus 11 also includes a computer network or other controller 40, and which is coupled in controlling relation relative to each of the plurality of illuminators 140, and image capturing devices 20. The image signal of each of the image capturing devices 20 are delivered to the computer network or controller 40. The controller or computer network 40 selectively energizes individual illuminators 140 and image capturing devices 20 in a predetermined sequence so as to generate multiple image signals and which are received by the controller or computer network 40 and which are combined into multiple aspect images, in real time, and which have multiple characteristics and gradients of the measured characteristics, and wherein the multiple aspect image which is formed allows the controller or computer network 40 to identify individual objects or products passing through the inspection station 18, and which have a predetermined feature or features. Further, the sorting apparatus 11 includes a product ejector 19 which is controllably coupled to the controller or computer network 40, and which when actuated by the controller or computer network 40 removes individual products 16 from the inspection station 18 having the features identified by the controller or computer network 40, and which were previously derived from the individual multiple aspect images which were previously formed by the controller or computer network 40, and assembled from the assorted image signals generated by the respective image capturing devices 20.

More specifically, the present invention 10 relates to a light source for use in combination with a sorting apparatus 11, and which includes a linear light emitting diode [LED] illuminator 140 having a multiplicity of individual LEDs 81 and 181, respectively, and which are oriented in a predetermined spatial pattern. The LED illuminator 140 is fabricated of multiple modules 130, and further has integrated optics 83, and control electronics 90 which allow the respective LEDs 82 and 182 to be selectively energized and de-energized. The linear, LED illuminator 140 can be selectively controlled by a computer network or controller 40 to selectively energize and de-energize the respective LEDs forming the LED illuminator 140 in a predetermined manner so as to provide control over an emission time and duration of the energizing of the respective LEDs 82 and 182 respectively; and/or a selected luminous emission for the respective LEDs 82 and 182 respectively; and/or a substantially simultaneous pulsed illumination of predetermined LEDs 82/182 respectively; and/or a coordinated, sequential energizing of the selected LEDs 82/182 respectively, so as to provide a sequential, pre-determined, visibly luminous or invisible emission 150 and 185, respectively, for the linear LED illuminator 140. The present invention 10 also includes a light diffuser member 110 and 174, respectively, and which is located in spaced relation relative to the linear LED illuminator 140. The respective light diffuser members receive, and pass, the luminous output or other emission of the energized linear LED illuminator 140, and which further causes the luminous or other output of the linear LED illuminator to become substantially uniform The light source 10 for the sorting apparatus 11, and which includes the linear LED illuminator 140 having the multiple LEDs 15, are selectively energized so as to emit multiple wavelengths of electromagnetic radiation which may be visible or invisible. As earlier discussed, the LED illuminator 140 is formed of multiple modules 130 which matingly, and operably cooperate with each other. In the drawings, as provided, the multiple LEDs 82, and 182, respectively, are fabricated in a chip-on-board 80,180 construction. As seen in the drawings, the respective modules 130 are operably coupled with each other, but can be separated or decoupled so as to facilitate repair and/or replacement of defective modules 130. In the arrangement as seen in the drawings, the linear LED illuminator 140 has a length dimension of typically less than about three meters. Further, the linear LED illuminator 140, when energized, generates a predetermined uniform illumination which has a working distance of typically less than about 1.5 meters. In the arrangement as seen in the drawings, the linear LED illuminator 140 has a predetermined length dimension. Further, the linear LED illuminator when energized produces a luminous output which is characterized by a discrete luminous beam 150. The discrete luminous beam 150 has a major projection axis 151, and which has a length dimension of about 1 to about 1.5 times the length of the linear LED illuminator 140. In the arrangement as seen in the drawings, it should be understood that the discrete luminous beam 150 has a minor projection axis 152. The discrete luminous beam 150 which is generated by the energized linear LED illuminator 140 has a beam width and which, when measured along the minor projection axis 152, is less than about 100 millimeters.

In the arrangement as seen in the drawings, the discrete luminous beam 150 has a peak luminous intensity, when measured along the major projection axis 151. Still further a non-uniform light output of the energized linear LED illuminator is less than about 20% of the peak luminous intensity of the discrete luminous beam 150 when measured along the major projection axis 151. It should be understood that the discrete luminous beam 150 has a beam width, and further has a light output when measured in a region outside the width of the luminous beam 150 and which is less than about 10% of the peak luminous intensity of the discrete luminous beam 150. In the arrangement as seen in the drawings the linear LED illuminator 140 has a predetermined width dimension which permits the linear LED illuminator to be received within an internal cavity 51 of the translucent enclosure 150. The translucent enclosure 150 typically has a cross-sectional dimension of less than about 3.75 inches. The light source 10 for the sorting apparatus 11 further includes a cooling assembly 65,171, and which is mounted within the internal cavity 51 of the translucent enclosure 50. The cooling assembly is further oriented in heat dissipating relation relative to the energized, linear LED illuminator 140. In the form of the invention as seen in the drawings, an optical projection lens 120 is provided, and which receives the luminous output of the energized linear LED illuminator 140, and then forms the discrete luminous beam 150. The light diffuser member 110 is located between the linear LED illuminator 140, and the optical projection lens 120 in the first form of the invention 60. It should be understood that the light diffuser member 110 is fabricated from a synthetic, translucent substrate which typically has a random surface topography, and which changes, at least in part, the direction of the electromagnetic radiation passing therethrough so as to produce the resulting uniformly discrete luminous beam 150. It should be understood that the light source 10, as described herein, is useful in implementing a method for sorting and which includes in its broadest aspect, a first step of providing a stream 15 of individual products 16 to be sorted, and wherein the individual products 16 have a multitude of characteristics. The method of sorting further includes another step of moving the individual products 15 through an inspection station 18. Still further the method includes another step of providing a plurality of detection devices 20 in the inspection station 18 for identifying a multitude of characteristics of the individual products 16. In this regard the respective detection devices 20, when actuated, generate a device signal. In this arrangement, at least some of the plurality of detection devices 20, if actuated simultaneously may interfere in the operation of other actuated detection devices. The method includes another step of providing a controller or computer network 40 for selectively actuating the respective detection devices 20 in a predetermined order, and in real-time, so as to prevent interference in the operation of the selectively actuated detection devices 20. The method further comprises another step of delivering the device signals generated by the respective detection devices 20 to the controller or computer network 40. The method also includes another step of forming a real-time multiple-aspect representation of the individual objects or products 16 passing through the inspection station 18 with the controller or computer network 40, by utilizing the respective device signals generated by the respective detection devices 20. The multiple-aspect representation of the objects has a plurality of features formed from the characteristics detected by the respective detection devices 20. The method further includes another step of sorting the individual objects or products 16 based, at least in part, upon the multiple-aspect representation formed by the controller or computer network 40, in real-time, as the individual objects or products 16 pass through the inspection station 18.

It should be understood that the multiple characteristics of the individual products 16 and the product stream 15 are selected from the group comprising color; light polarization; fluorescence; surface texture; and translucence. It should be understood that these characteristics can be formed from electromagnetic radiation which is spectrally reflected, or transmitted by the respective objects or products 16. It should also be understood, that the step of providing a plurality of detection devices 20 further includes, providing a plurality of selectively energizable illuminators 140 which emit, when energized, electromagnetic radiation 84 which is directed towards and is reflected at least in part from and/or transmitted by the individual objects or products 16 which are passing through the inspection station 18 or from the background illuminator which comprises the second form of the invention 160 (FIG. 5). In this methodology the image capturing devices 20 are oriented so as to receive the electromagnetic radiation 84 which is coming from the individual objects or products 16 which are passing through the inspection station 18. In this arrangement the controller or computer network 40 is controllably coupled to each of the selectively energizable illuminators 140, and the selectively operable image capturing devices 20, so as to provide the required device signals upon which a subsequent sorting decision can be made.

Therefore, the present invention provides many advantages over the illumination devices utilized, heretofore, for sorting a product stream. The present invention further provides a convenient means whereby the destructive interference that might result from the operation of multiple detectors, and illuminators, is substantially avoided, and simultaneously provides a means for the collection of multiple levels of data which can then be assembled, in real time, to provide a means for making highly sophisticated and intelligent sorting decisions in a manner not possible with the prior art and commercially available devices utilized in the past.

In compliance with the statute, the invention has been described in language more or less specific as to structural and methodical features. It is to be understood, however, that the invention is not limited to the specific features shown and described since the means herein disclosed comprise preferred forms of putting the invention into effect. The invention is, therefore, claimed in any of its forms or modifications within the proper scope of the appended claims appropriately interpreted in accordance with the Doctrine of Equivalence.

We claim:

1. A light source for a sorting apparatus, comprising:

an illuminator having a multiplicity of modules which are operably coupled together and which further mount a plurality of light emitting diodes (LEDs) in a predetermined spatial pattern, and wherein the respective modules of the illuminator have control electronics which are operably coupled with, and respond to a command sent by a computer network, and wherein the computer network, acting in combination with the control electronics, parametrically controls a temporal, spatial and spectral energizing and de-energizing of the respective modules, and individual LEDs so as to emit a luminous emission having predetermined characteristics;

a light diffuser member located in spaced relation relative the illuminator and which passes and substantially renders the luminous emission substantially uniform;

and wherein the respective multiplicity of modules are operably coupled together to form a linear LED illuminator, and wherein the linear LED illuminator has integrated optics which are individually, and operably associated with at least some of the respective LEDs;

an optical projection lens which receives the luminous emission of the energized linear LED illuminator, and forms a discrete luminous beam, and wherein the light diffuser member is located between the linear LED illuminator, and the optical projection lens;

a cooling assembly which is oriented in heat dissipating relation relative to the energized linear LED illuminator, and wherein the cooling assembly, and the linear LED illuminator are dimensioned to be received within an internal cavity of an enclosure, and which is at least partially translucent, and which further passes the discrete luminous beam, and wherein the internal cavity of the enclosure has a cross-sectional dimension of at least about 3.75 inches;

and wherein the respective LEDs forming the linear LED illuminator comprise LEDs which, when energized, emit multiple wavelengths of electromagnetic radiation which may be visible or invisible;

and wherein the linear, LED illuminator can be selectively controlled by the computer network to selectively energize and de-energize the respective LEDs forming the linear LED illuminator in a predetermined manner so as to provide control over an emission time, and a duration of the energizing of the respective LEDs; and/or a selected luminous emission for the respective LEDs; and/or a substantially simultaneous pulsed illumination of predetermined LEDs; and/or a coordinated, sequential energizing of selected LEDs so as to provide a sequential, predetermined, and discrete luminous beam for the linear LED illuminator;

and wherein the linear LED illuminator, when energized, generates a predetermined, uniform illumination which has a working distance of less than about 1.5 meters;

and wherein the linear LED illuminator has a predetermined length dimension, and wherein the linear LED illuminator, when energized, produces a discrete luminous beam which has a major projection axis and which further has a length dimension of about 1 to about 1.5 times the length dimension of the linear LED illuminator;

and wherein the discrete luminous beam which is generated by the energized linear LED illuminator has a beam width which, when measured along the minor projection axis, is less than about 100 mm; and wherein the discrete luminous beam has a peak luminous intensity, when measured along the major projection axis, and wherein a non-uniform light output of the energized linear LED illuminator is less than about 20% of the peak luminous intensity of the discrete luminous beam when measured along the major projection axis.

2. A light source for a sorting apparatus as claimed in claim 1, and wherein the discrete luminous beam has a peak luminous intensity when measure along the minor projection axis, and wherein a non-uniform light output of the energized linear LED illuminator is less than about 30% of the peak luminous intensity of the discrete luminous beam when measured along the minor projection axis.

3. A light source for a sorting apparatus as claimed in claim 2, and wherein the discrete luminous beam has a beam width, and further has a light output, when measured in a region outside of the width of the luminous beam, and which is less than about 10% of the peak of luminous intensity of the discrete luminous beam.

4. A light source for a sorting apparatus as claimed in claim 1, and wherein the light diffuser member comprises a synthetic, translucent substrate which has a top surface having a random surface topography, and which changes a direction of travel of the electromagnetic radiation which is emitted and passes therethrough, so as to provide a uniform discrete luminous beam.

5. A light source for a sorting apparatus, comprising:

a linear, Light Emitting Diode (LED) illuminator having a multiplicity of individual LED's which are oriented in a predetermined spatial pattern, and wherein the LED illuminator is fabricated of multiple modules, and further has integrated optics and control electronics which allow the respective LED's to be selectively energized and de-energized; and wherein the linear, LED illuminator can be selectively controlled by a computer network to selectively energize and de-energize the respective LEDs forming the LED illuminator in a predetermined manner so as to provide control over an emission time and a duration of the energizing of the respective LEDs; and/or a selected luminous emission for the respective LEDs; and/or a substantially simultaneous pulsed illumination of predetermined LEDs; and/or a coordinated, sequential energizing of selected LEDs so as to provide a sequential, predetermined, luminous emission for the linear LED illuminator;

a light diffuser member located in spaced relation relative to the linear, LED illuminator, and which receives and passes the luminous output of the energized linear LED illuminator, and which further causes the luminous output of the linear, LED illuminator to become substantially uniform;

and wherein the respective LEDs forming the linear LED illuminator comprise LEDs which, when energized, emit multiple wavelengths of electromagnetic radiation which may be visible or invisible;

and wherein the linear LED illuminator is formed of multiple modules which matingly and operably cooperate with each other;

and wherein the multiple LEDs are fabricated in a chip on-board construction, and wherein the respective multiple modules are operably coupled with each other;

and wherein the linear LED illuminator has a predetermined length dimension, and wherein the linear LED illuminator, when energized, produces a luminous output characterized by a discrete, luminous beam, and wherein the discrete luminous beam has a major projection axis which has a length dimension of about 1 to about 1.5 times the length dimension of the linear LED illuminator;

and wherein the discrete luminous beam has a minor projection axis, and wherein the discrete luminous beam which is generated by the energized linear LED illuminator has a beam width, and which, when measured along the minor projection axis, is less than about 100 mm; and wherein the discrete luminous beam has a peak luminous intensity, when measured along the major projection axis, and wherein a non-uniform light output of the energized linear LED illuminator is less than about 20% of the peak luminous intensity of the discrete luminous beam when measured along the major projection axis.

6. A light source for a sorting apparatus as claimed in claim 5, and wherein the discrete luminous beam has a peak luminous intensity when measure along the minor projection axis, and wherein a non-uniform light output of the energized linear LED illuminator is less than about 30% of the peak luminous intensity of the discrete luminous beam when measured along the minor projection axis.

7. A light source for a sorting apparatus as claimed in claim 6, and wherein the discrete luminous beam has a beam width, and further has a light output, when measured in a region outside of the width of the luminous beam, and which is less than about 10% of the peak of luminous intensity of the discrete luminous beam.

8. A light source for a sorting apparatus as claimed in claim 7, and wherein the linear LED illuminator has a predetermined width dimensioned which permits the linear LED illuminator to be received within an internal cavity of a translucent enclosure, and wherein the translucent enclosure has a cross-sectional dimension of less than about 3.75 inches.

9. A light source for a sorting apparatus as claimed in claim 8, and further comprising a cooling assembly which is mounted within the internal cavity of the translucent enclosure and is further oriented in heat dissipating relation relative to the energized linear LED illuminator.

10. A light source for a sorting apparatus as claimed in claim 9, and further comprising an optical projection lens which receives the luminous output of the energized linear LED illuminator, and forms the discrete luminous beam, and wherein the light diffuser member is located between the linear LED illuminator and the optical projection lens.

11. A light source for a sorting apparatus as claimed in claim 10, and wherein the light diffuser member comprises a synthetic, translucent substrate, and which further has a random surface topography which changes the direction of the emitted electromagnetic radiation passing there through so as to produce the resulting, uniformly discrete luminous beam.

* * * * *